US006390259B1

(12) United States Patent
Lu

(10) Patent No.: US 6,390,259 B1
(45) Date of Patent: May 21, 2002

(54) WHEELED LUGGAGE WITH EXPANDABLE BODY

(75) Inventor: Lien Ching Lu, Miaoli Hsien (TW)

(73) Assignee: Ting Cheng Co., Ltd., Miaoli Hsien (TW)

( * ) Notice: Subject to any disclaimer, the term of this patent is extended or adjusted under 35 U.S.C. 154(b) by 0 days.

(21) Appl. No.: 09/846,185

(22) Filed: May 2, 2001

(51) Int. Cl.[7] ..... A45C 7/00
(52) U.S. Cl. ..... 190/103; 190/105
(58) Field of Search ..... 190/103, 104, 190/105, 107

(56) References Cited

U.S. PATENT DOCUMENTS 5,749,446 A * 5/1998 Hsieh ..... 190/103 X
6,021,874 A * 2/2000 Nykoluk ..... 190/103
6,220,411 B1 * 4/2001 Scicluna et al. ..... 190/103
6,305,513 B1 * 10/2001 Lu ..... 190/103

* cited by examiner

*Primary Examiner*—Lee Young
*Assistant Examiner*—Tri M. Mai
(74) *Attorney, Agent, or Firm*—Rosenberg, Klein & Lee

(57) ABSTRACT

A wheeled luggage with expandable body has two support mechanisms each comprising a sliding board secured to the side of auxiliary body, a locking mechanism secured to the side of main body and comprising two opposite locking members each having a ratchet member, and a trigger mechanism comprising a plate member, a trigger member, and two sliding members. In an unused position, the width of a flexible section is reduced to a minimum by closing the zipper and the sliding member is engaged with the rear tooth of the ratchet member, thereby preventing the sliding board from forward moving. The width of the flexible section is increased to a maximum by opening the zipper in a use position. The plate member is pushed rearward for disengaging the sliding members from the ratchet members, thereby permitting a rearward sliding of the sliding board from the use position to the unused position.

4 Claims, 10 Drawing Sheets

WHEELED LUGGAGE WITH EXPANDABLE BODY

FIELD OF THE INVENTION

The present invention relates to luggage and more particularly to a wheeled luggage having a flexible section in which the expansion or compression of the flexible section is made more reliable by a pair of improved support mechanisms.

BACKGROUND OF THE INVENTION

A conventional wheeled luggage 10 with expandable body is shown in FIGS. 1 and 2. The luggage 10 comprises a main body 11 supported by a main frame 14, an auxiliary body 15, a flexible section 13 sandwiched between main body 11 and auxiliary body 15, and a cover 12 coupled to the auxiliary body 15. In an unused position, the width of flexible section 13 is reduced to a minimum by closing zipper 131. In contrast, in a use position the width of flexible section 13 is increased to a maximum by opening zipper 131 so as to store personal belongings in the luggage. However, the previous design suffered from a disadvantage. For example, the bottom 132 of flexible section 13 is bulged by the weight of personal belongings stored in the luggage 10. Such bulged portion 132 may hinder the wheeling of luggage 10 due to the contact with the ground. Thus, improvement exists in order to overcome the above drawback of prior art.

SUMMARY OF THE INVENTION

It is therefore an object of the present invention to provide a wheeled luggage comprising a main body, an auxiliary body, a flexible section sandwiched between the main body and the auxiliary body and having a zipper, a pair of support mechanisms provided on the opposite sides of the luggage, and a cover coupled to the auxiliary body, each of the support mechanisms comprising a sliding board secured to the side of the auxiliary body and comprising a first groove rail on either the top or the bottom side, a flat recess, a lower vertical channel and an upper vertical channel on one side, a horizontal channel in the center having two opposite shoulders in one end joined with the facing ends of the vertical channels, an elongate horizontal slot in the other end, and an elongate trough coupled between the elongate horizontal slot and the shoulders; a locking mechanism secured to the side of the main body and comprising two opposite locking members each including a ratchet member, and a groove in one end for guiding the first groove rail to match therewith; and a trigger mechanism comprising a plate member including an elongate plate, an enlarged end member in one end, an aperture through the other end, a projection on the back slidably received in the trough, two spaced posts on one side of the end member with the plate located therebetween, two elastic members put on the posts and each having one end biased against the shoulder, and two spaced pins; a trigger member on the back of the sliding board and including a sleeve on one side inserted through the elongate horizontal slot of the sliding board and the aperture and a lock pin inserted into the sleeve for coupling the trigger member to the plate member; and a pair of sliding members received in the vertical channels respectively and each having an elongate slanted slot in one end facing the other sliding member with the pin defined therein and a slanted end in the other end engaged with one of the teeth of each ratchet member; wherein in an unused position, the width of the flexible section is reduced to a minimum by closing the zipper and each slanted end engaged with the rear tooth of the ratchet member, thereby preventing the sliding board from forward moving at the unused position; the sliding board is operative to slide forward to cause the auxiliary body to move away from the main body with each slanted end sliding on the teeth of each ratchet member until the width of the flexible section has reached a maximum in a use position and each slanted end is engaged with the front tooth of each ratchet member once the sliding of the slanted ends is stopped, thereby preventing the sliding board from backward moving at the use position; or the lock pin is continuously pushed rearward to cause the plate member to move rearward for compressing the elastic members, the sliding members are forced to move toward each other with the pins moved from lowest positions in the slanted slots to highest positions therein, each slanted end is disengaged from the ratchet member, and the sliding board is operative to slide rearward until the width of the flexible section has reached the minimum and once the lock pin is released each slanted end is again engaged with the rear tooth of each ratchet member, thereby preventing the sliding board from forward moving at the unused position.

The above and other objects, features and advantages of the present invention will become apparent from the following detailed description taken with the accompanying drawings.

DETAILED DESCRIPTION OF THE PREFERRED EMBODIMENTS

Figure 1:
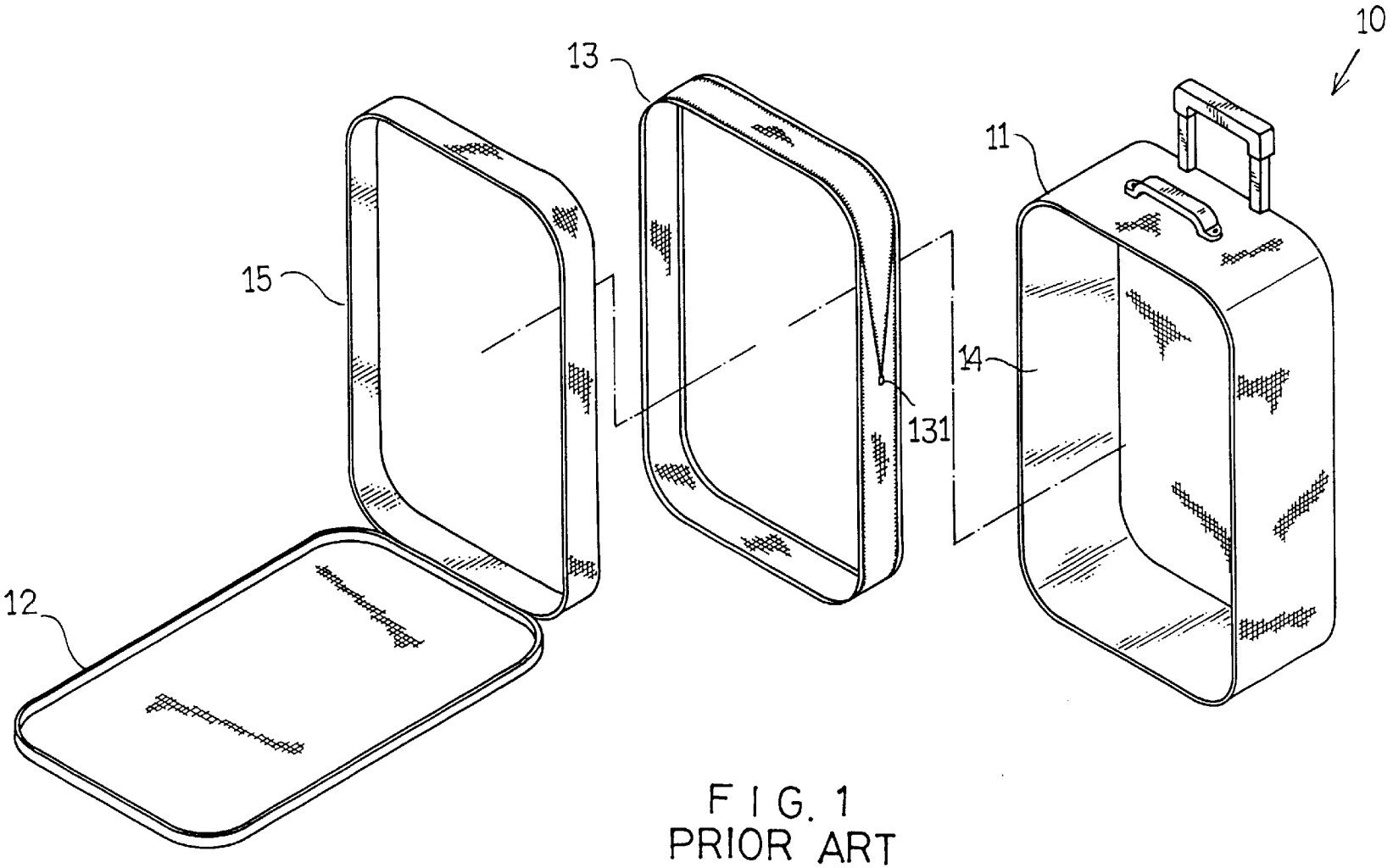
FIG. 1 PRIOR ART
FIG. 1 is an exploded view of a conventional wheeled luggage with expandable body.
Figure 2:
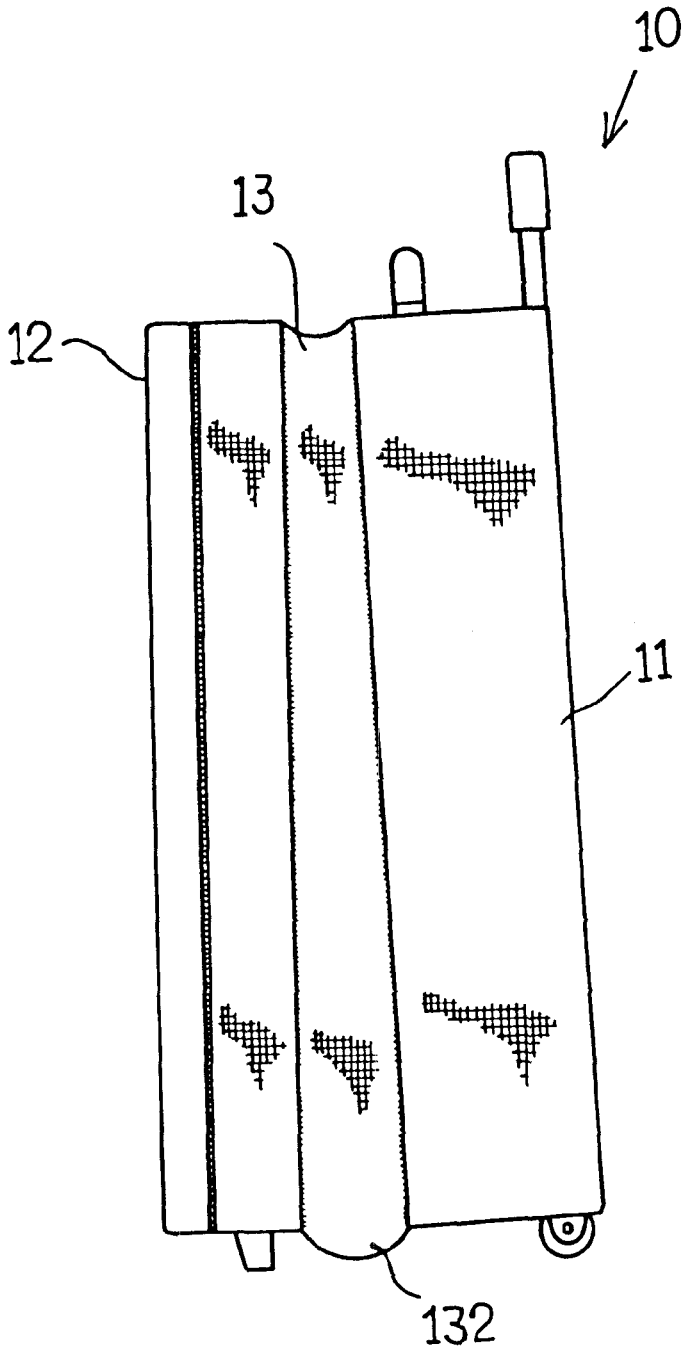
FIG. 2 PRIOR ART
FIG. 2 is a side view of the assembled FIG. 1 luggage.
Figure 3:
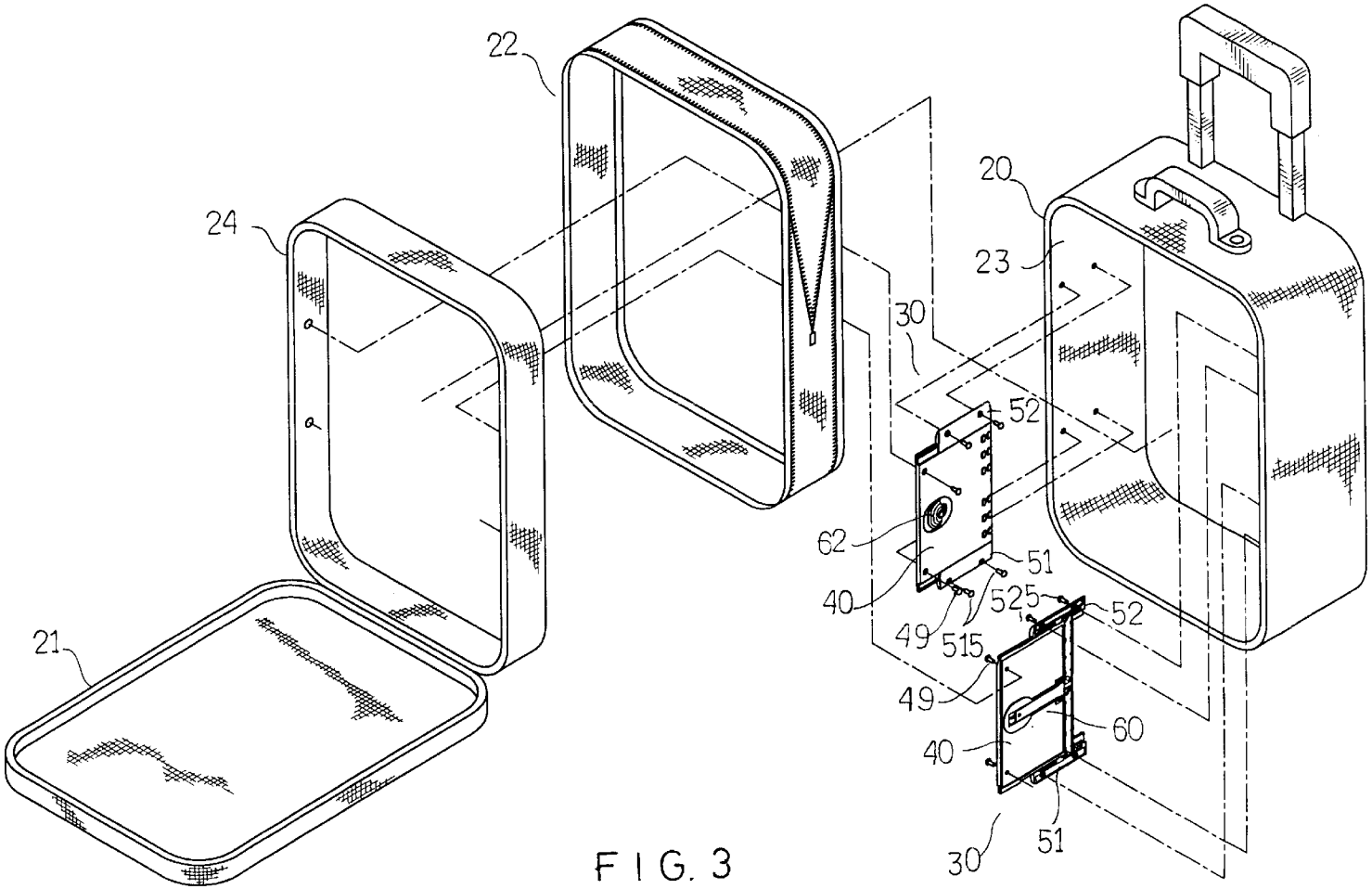
FIG. 3 is an exploded view of a wheeled luggage with expandable body according to the invention.
Figure 4:
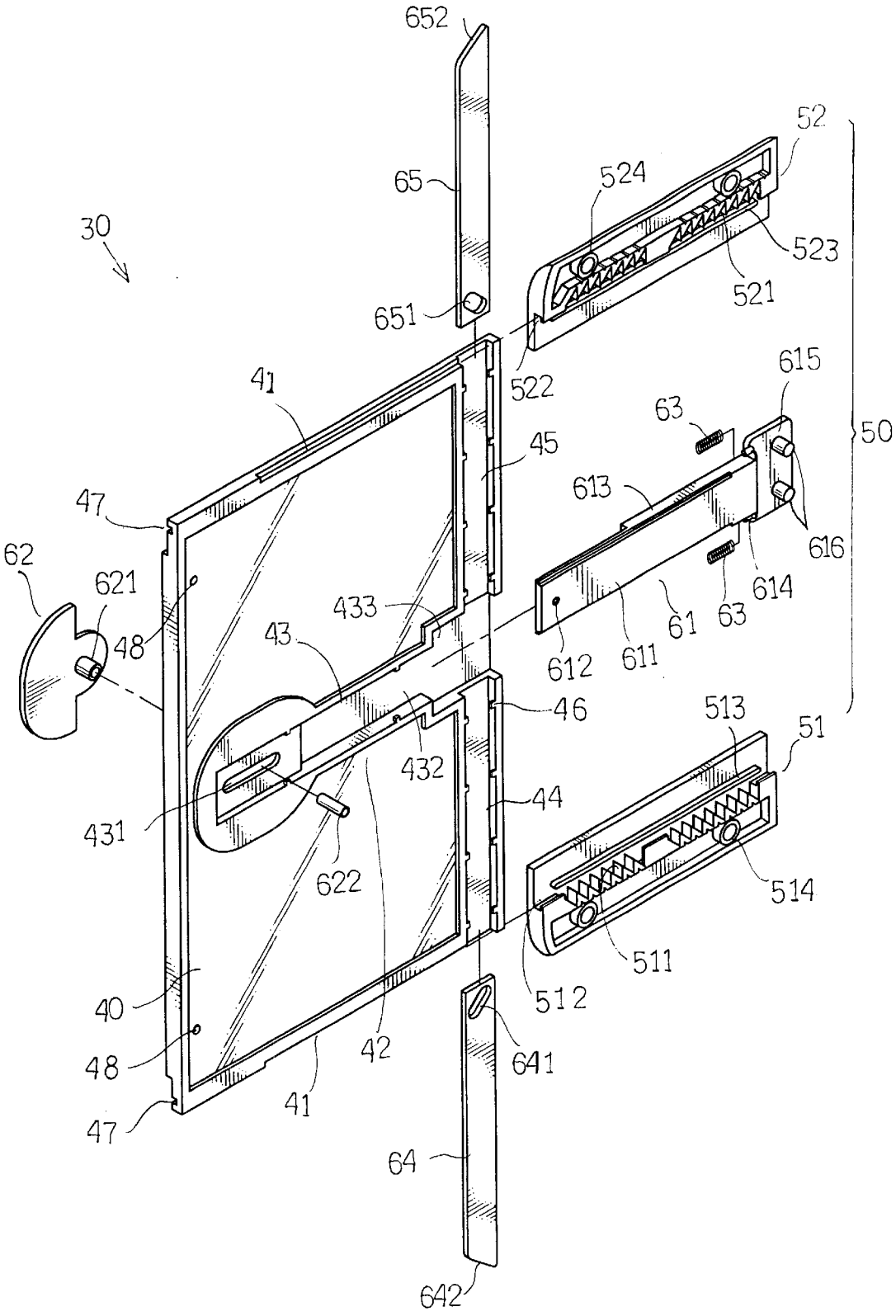
FIG. 4 is an exploded view of support mechanism shown in FIG. 3.

Referring to FIGS. 3 to 6, there is shown a wheeled luggage constructed in accordance with the invention comprising a main body 20 having a main frame 23 and a fabric 25 covered on the main frame 23, an auxiliary body 24, a flexible section 22 sandwiched between the main body 20 and the auxiliary body 24 and having a zipper 221, a pair of support mechanisms 30 provided on the opposite sides of the luggage, and a cover 21 coupled to the auxiliary body 24. The characteristics of the invention is the improved support mechanisms 30 as detailed below.

Figure 5:
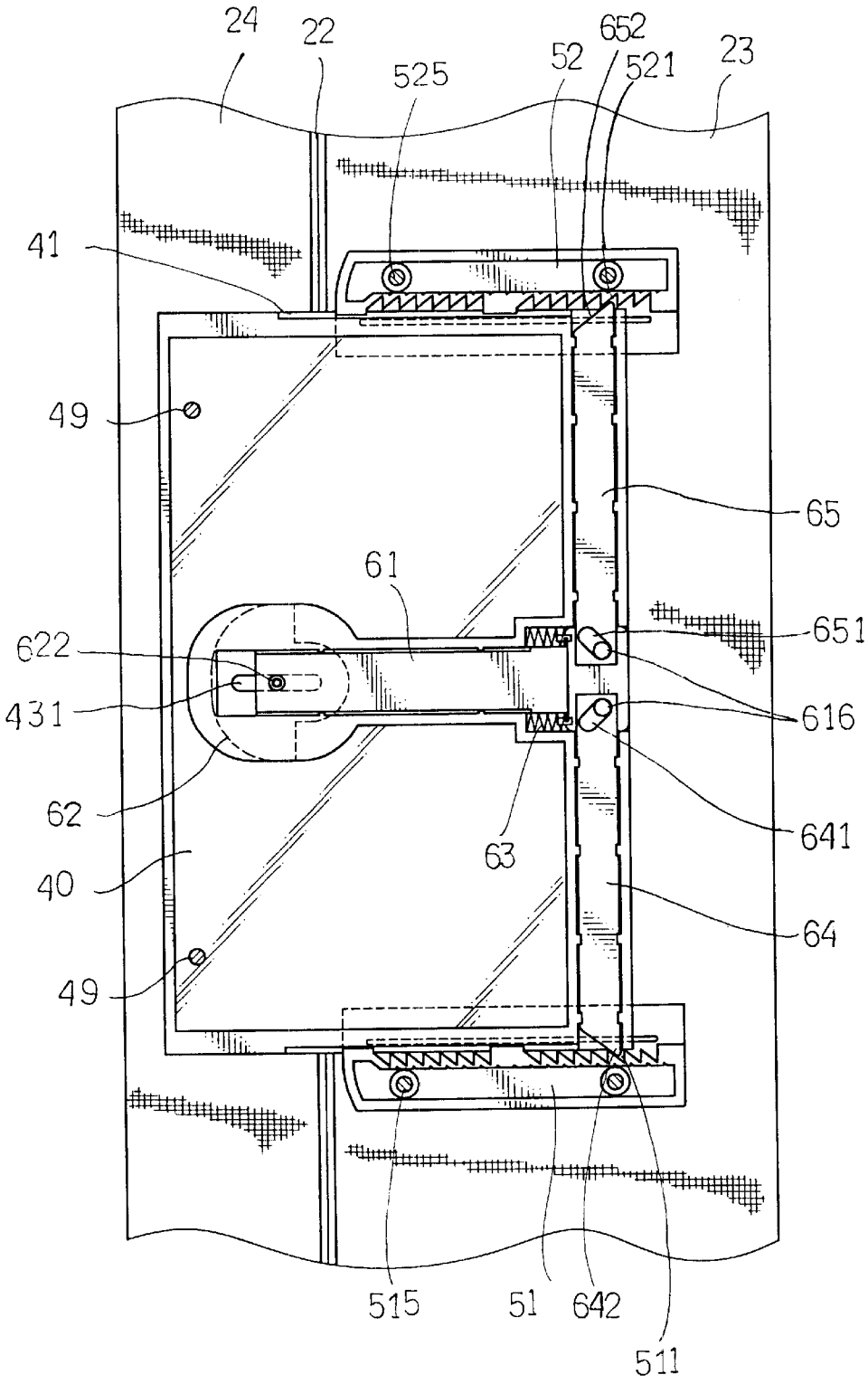
FIG. 5 is a side view schematically showing the assembled support mechanism of FIG. 4 where flexible section is compressed to a minimum.
Figure 6:
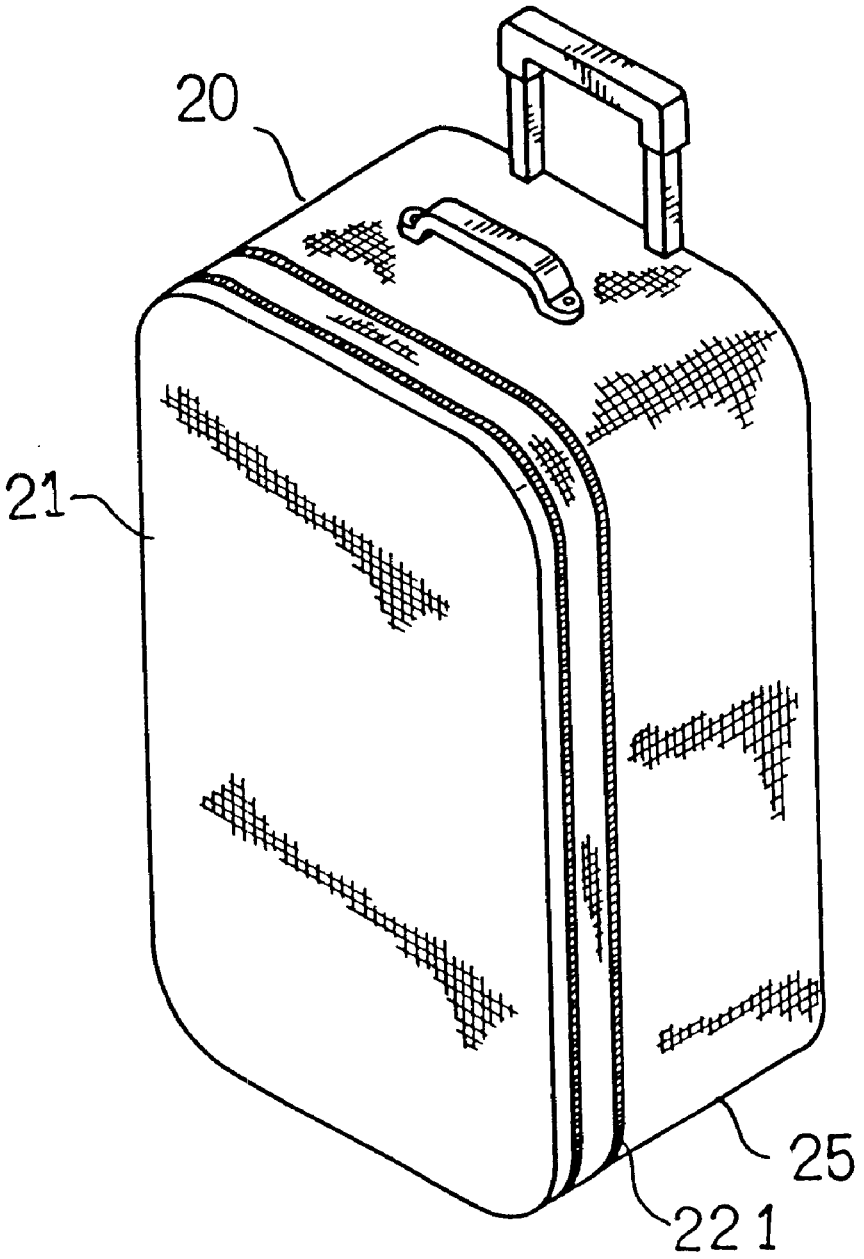
FIG. 6 is a perspective view of the FIG. 5 luggage.

Each support mechanism 30 comprises a rectangular sliding board 40 comprising a first groove rail 41 on either top or bottom side, a flat recess 42, a lower vertical channel 44 on inner side, an upper vertical channel 45 on the inner side, a horizontal channel 43 in the center having two opposite shoulders 433 in one end joined with the facing ends of the vertical channels 44 and 45, an elongate horizontal slot 431 in the other end, and an elongate trough 432 coupled between the elongate horizontal slot 431 and the shoulders 433, a plurality of risers 46 projected from either side of vertical channels 44 and 45, a second groove rail 47 adjacent each of the first groove rails 41, a pair of spaced first holes 48, and a pair of fasteners 49 (e.g., screws) driven through first holes 48 to secure support mechanism 30 to the sides of the auxiliary body 24; a locking mechanism 50 comprising two opposite locking members 51 and 52 each including a ratchet member 511 (or 521) facing the other, a groove 512 (or 522) in one end for guiding the first groove rail 41 to match therewith, an elongate flange 513 (or 523) on the same side as the groove 512 (or 522) for matingly engaging with the second groove rail 47, a plurality of second holes (two are shown) 514 (or 524), and a plurality of fasteners (e.g., screws) 515 (or 525) driven through second holes 514 (or 524) to secure support mechanism 30 to the sides of the main frame 23; and a trigger mechanism 6 comprising a plate member 61 including an elongate plate 611, an enlarged end member 615 in one end, an aperture 612 through the other end, a projection 613 on the back slidably received in the trough 432, two spaced posts 614 on one side of the end member 615 with the plate 611 located therebetween, two coil springs 63 each put on the post 614 and having one end biased against the shoulder 433, and two spaced pins 616; a trigger member 62 on the back of the sliding board 40 and including a sleeve 621 on one side inserted through the elongate horizontal slot 431 of the sliding board 40 and the aperture 612 and a lock pin 622 inserted into the sleeve 621 for coupling the trigger member 62 to the plate member 61; and a pair of sliding members 64 and 65 slidably received in the vertical channels 44 and 45 respectively with the guiding of the risers 46 and each having an elongate slanted slot 641 (or 651) in one end facing the other sliding member 65 (or 64) with the pin 616 defined therein and a slanted end 642 (or 652) in the other end engaged with one of the teeth of the ratchet member 511 (or 521). In an unused position, the width of flexible section 22 is reduced to a minimum by closing zipper 221 in which the sliding board 40 has been slid inward to cause the auxiliary body 24 to move toward the main body 20 with the slanted ends 642 and 652 engaged with the rear teeth of the ratchet members 511 and 521 respectively, thus preventing the sliding board 40 from forward moving at this position, i.e., locking the support mechanisms 30 for preventing the flexible section 22 and the luggage from expanding (FIGS. 5 and 6).

Figure 7:
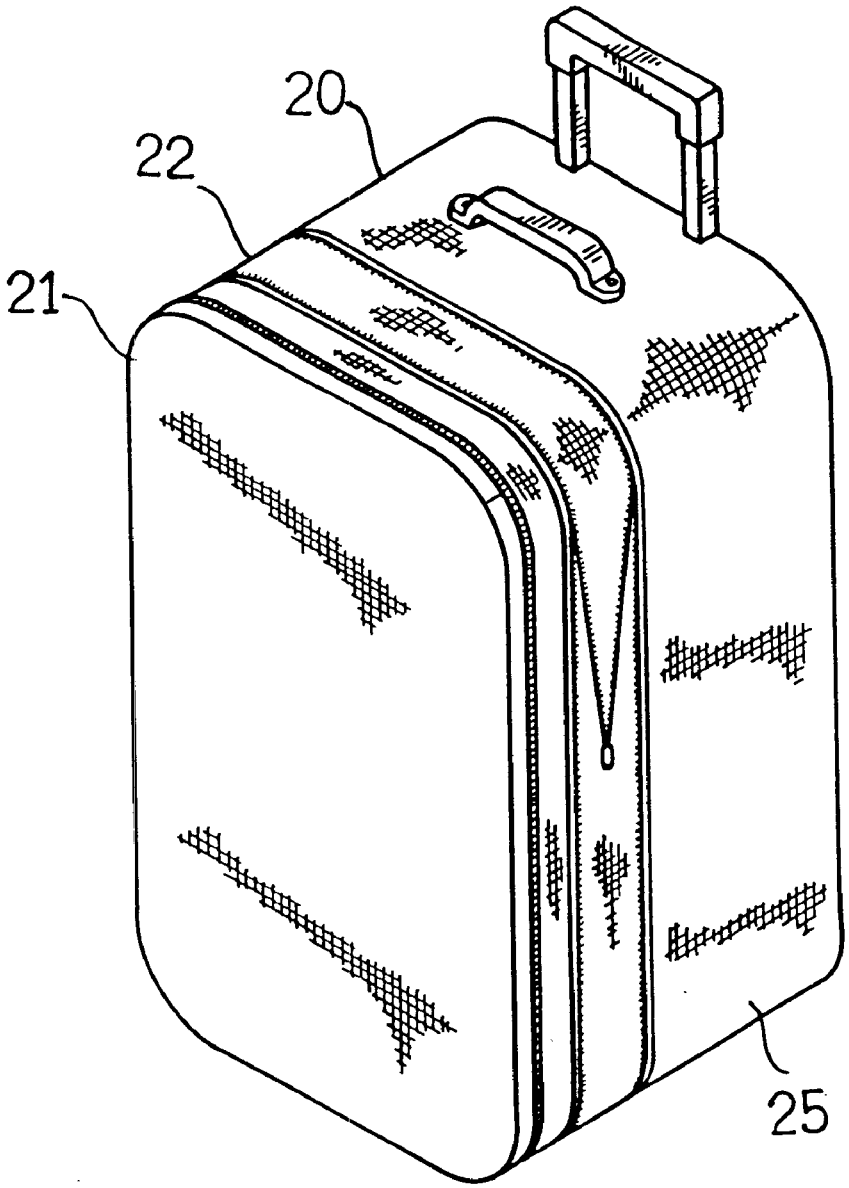
FIG. 7 is a perspective view of the assembled FIG. 3 luggage where zipper of flexible section has been opened in a use position.
Figure 8:
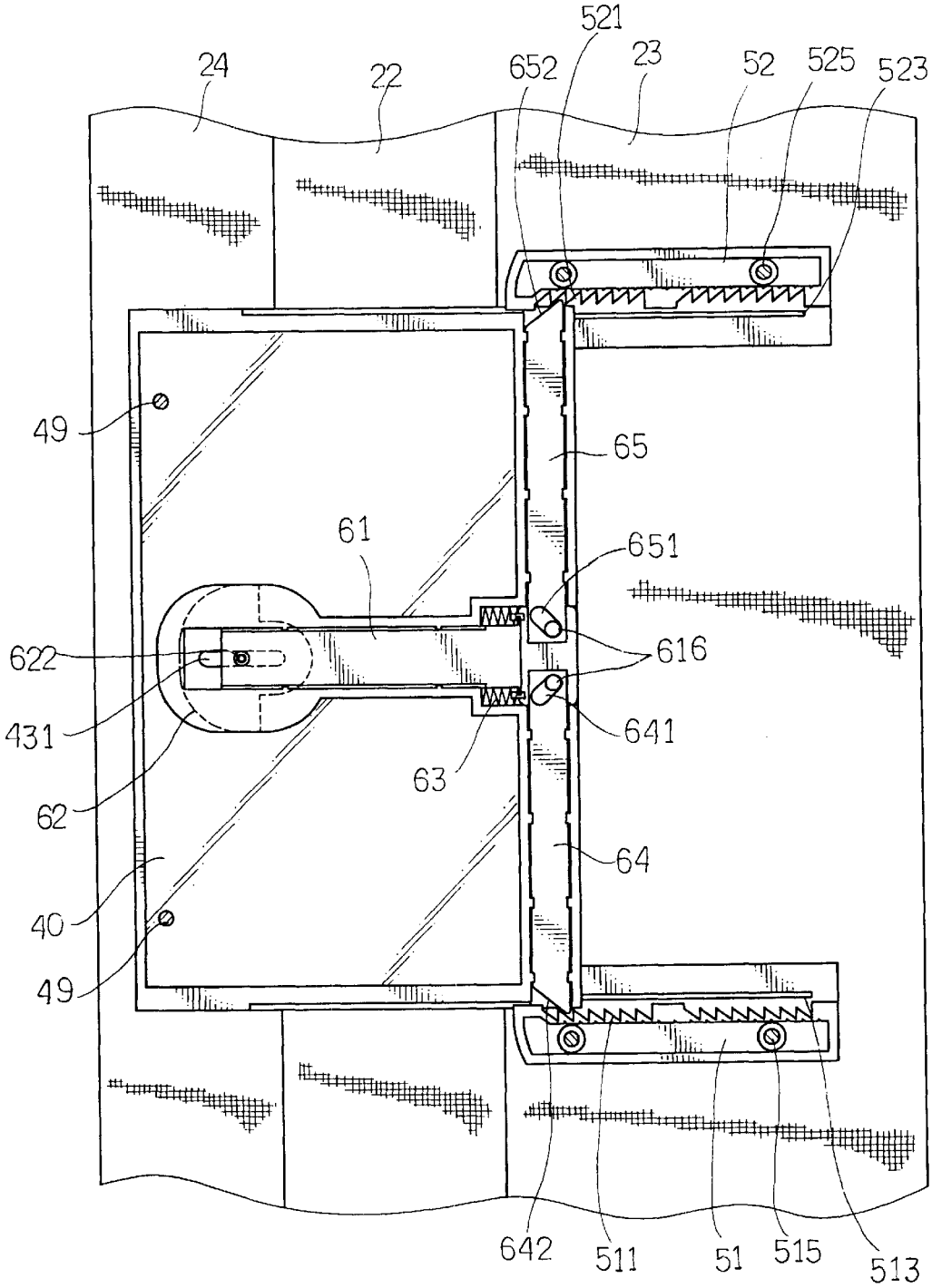
FIG. 8 is a view similar to FIG. 5 where flexible section is expanded to a maximum.
Figure 9:
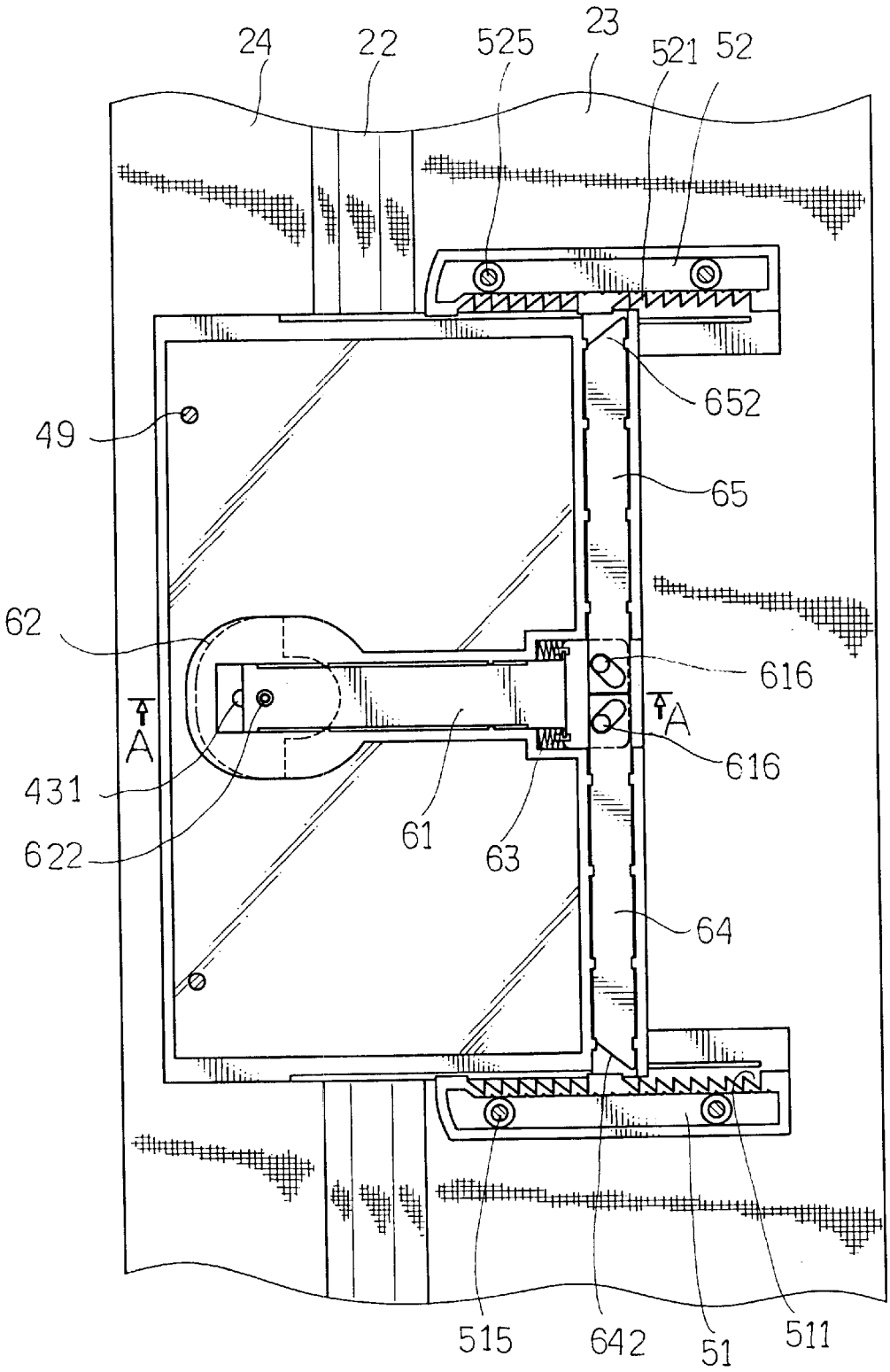
FIG. 9 is a view similar to FIG. 5 where flexible section is being compressed.
Figure 10:
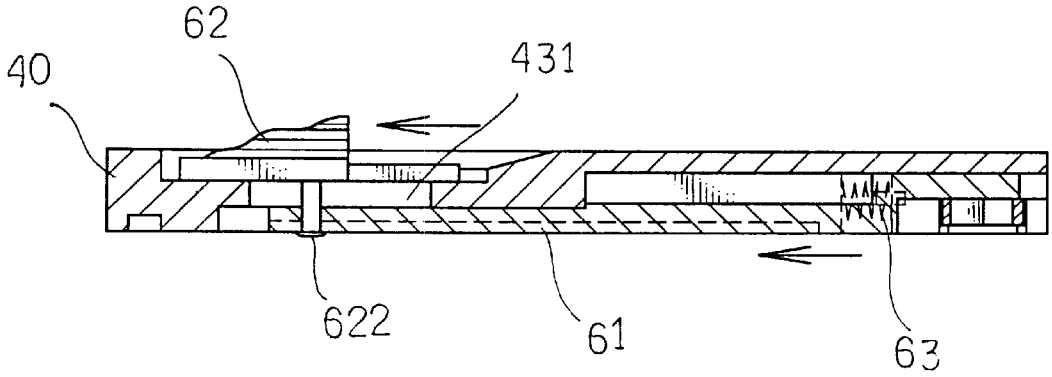
FIG. 10 is a sectional view taken along line A—A of FIG. 9.

Referring to FIGS. 7 to 10, the operation of the support mechanisms 30 will now be described in detail in the case that a user wants to pack personal belongings into the luggage. The user may slide the sliding board 40 forward to cause the auxiliary body 24 to move away from the main body 20 with the slanted ends 642 and 652 sliding on the teeth of the ratchet members 511 and 521 respectively until the width of the flexible section 22 has reached its maximum (FIGS. 7 and 8). Once the sliding of the slanted ends 642 and 652 is stopped, they are engaged with the front teeth of the ratchet members 511 and 521 respectively, thus preventing the sliding board 40 from backward moving at this position, i.e., locking the support mechanisms 30 for preventing the flexible section 22 and the luggage from compressing. In contrast, if users wants to compress the flexible section 22 to its minimum width in an unused position of the luggage a number of operations must be performed as detailed below. First, continuously push the lock pin 622 rearward to cause the plate member 61 to move rearward, thus compressing the coil springs 63. Then the sliding members 64 and 65 are forced to move toward each other with the pins 616 moved from the lowest positions in the slanted slots 641 and 651 (FIG. 8) to the highest positions therein (FIG. 9). At this position, the slanted ends 642 and 652 are disengaged from the ratchet members 511 and 521 respectively. Hence, it is possible to slide the sliding board 40 rearward until the width of the flexible section 22 has reached its minimum. The slanted ends 642 and 652 are again engaged with the rear teeth of the ratchet members 511 and 521 respectively when the pushing force on the lock pin 622 is released. At the same time, the coil springs 63 are expanded to return to normal positions. As an end, the sliding board 40 is again prevented from forward moving at this position, i.e., locking the support mechanisms 30 for preventing the flexible section 22 and the luggage from expanding (FIGS. 5 and 6).

While the invention has been described by means of specific embodiments, numerous modifications and variations could be made thereto by those skilled in the art without departing from the scope and spirit of the invention set forth in the claims.

What is claimed is:

1. A wheeled luggage comprising a main body, an auxiliary body, a flexible section sandwiched between said main body and said auxiliary body and having a zipper, a pair of support mechanisms provided on said opposite sides of said luggage, and a cover coupled to said auxiliary body, each of said support mechanisms comprising:

a sliding board secured to said side of said auxiliary body and comprising a first groove rail on either said top or said bottom side a flat recess, a lower vertical channel and an upper vertical channel on one side, a horizontal channel in said center having two opposite shoulders in one end joined with said facing ends of said vertical channels, an elongate horizontal slot in said other end, and an elongate trough coupled between said elongate horizontal slot and said shoulders;

a locking mechanism secured to said side of said main body and comprising two opposite locking members each including a ratchet member, and a groove in one end for guiding said first groove rail to match therewith; and a trigger mechanism comprising a plate member including an elongate plate, an enlarged end member in one end, an aperture through said other end, a projection on said back slidably received in said trough, two spaced posts on one side of said end member with said plate located therebetween, two elastic members put on said posts and each having one end biased against said shoulder, and two spaced pins; a trigger member on said back of said sliding board and including a sleeve on one side inserted through said elongate horizontal slot of said sliding board and said aperture and a lock pin inserted into said sleeve for coupling said trigger member to said plate member; and a pair of sliding members received in said vertical channels respectively and each having an elongate slanted slot in one end facing said other sliding member with said pin defined therein and a slanted end in said other end engaged with one of said teeth of each ratchet member;

wherein in an unused position, said width of said flexible section is reduced to a minimum by closing said zipper and each slanted end engaged with said rear tooth of said ratchet member, thereby preventing said sliding board from forward moving at said unused position; said sliding board is operative to slide forward to cause said auxiliary body to move away from said main body with each slanted end sliding on said teeth of each ratchet member until said width of said flexible section has reached a maximum in a use position and each slanted end is engaged with said front tooth of each ratchet member once said sliding of said slanted ends is stopped, thereby preventing said sliding board from backward moving at said use position; or said lock pin is continuously pushed rearward to cause said plate member to move rearward for compressing said elastic members, said sliding members are forced to move toward each other with said pins moved from lowest positions in said slanted slots to highest positions therein, each slanted end is disengaged from said ratchet member, and said sliding board is operative to slide rearward until said width of said flexible section has reached said minimum and once said lock pin is released each slanted end is again engaged with said rear tooth of each ratchet member, thereby preventing said sliding board from forward moving at said unused position.

2. The wheeled luggage of claim 1, wherein said locking member further comprises an elongate flange on said same side as said groove and said sliding board further comprises a second groove rail adjacent said first groove rail for engaging with said elongate flange.

3. The wheeled luggage of claim 1, wherein said sliding board further comprises a plurality of risers projected from either side of each vertical channel for guiding said sliding members to receive in said vertical channels.

4. The wheeled luggage of claim 1, wherein said elastic member is a coil spring.

* * * * *